US009487978B2

(12) United States Patent
Aono

(10) Patent No.: US 9,487,978 B2
(45) Date of Patent: Nov. 8, 2016

(54) EARTHQUAKE-PROOF LATCH MECHANISM

(71) Applicant: MARUYOSHI KOGYO INC., Tokyo (JP)

(72) Inventor: Nobuyuki Aono, Tokyo (JP)

(73) Assignee: MARUYOSHI KOGYO INC., Tokyo (JP)

( * ) Notice: Subject to any disclaimer, the term of this patent is extended or adjusted under 35 U.S.C. 154(b) by 308 days.

(21) Appl. No.: 14/352,268

(22) PCT Filed: Oct. 29, 2013

(86) PCT No.: PCT/JP2013/079207

§ 371 (c)(1),
(2) Date: Apr. 16, 2014

(87) PCT Pub. No.: WO2014/167747

PCT Pub. Date: Oct. 16, 2014

(65) Prior Publication Data

US 2015/0240542 A1 Aug. 27, 2015

(30) Foreign Application Priority Data

Apr. 11, 2013 (JP) ..... 2013-082618

(51) Int. Cl.
*E05C 19/10* (2006.01)
*E05C 19/12* (2006.01)
(Continued)

(52) U.S. Cl.
CPC ..... *E05C 19/12* (2013.01); *E05B 2063/0095* (2013.01); *Y10T 292/0945* (2015.04)

(58) Field of Classification Search
CPC ..... E05C 19/12; E05C 19/009; E05B 2063/0095
USPC ..... 292/95, 96, 130, 131, 133, 132, 98, 292/194, 230, 231, 234, 235, 195, 197, 332, 292/336, DIG. 11, DIG. 22, DIG. 65
See application file for complete search history.

(56) References Cited

U.S. PATENT DOCUMENTS 5,312,143 A * 5/1994 Buckner ..... E05B 77/12 292/230
5,697,655 A * 12/1997 Strong ..... E05C 3/14 292/230

FOREIGN PATENT DOCUMENTS

JP A-2003-90165 3/2003
JP A-2005-120779 5/2005
(Continued)

OTHER PUBLICATIONS

Nov. 11, 2014 Office Action issued in Japanese Application No. 2013-082618.
(Continued)

*Primary Examiner* — Alyson M Merlino
(74) *Attorney, Agent, or Firm* — Oliff PLC

(57) ABSTRACT

An earthquake-proof latch mechanism includes a case body, a hook member which is swingably supported on the case body, and a pendulum member which is vibratably suspended and supported on the case body. The hook member includes a hook on one side of a swinging shaft and a pendulum engagement portion on the other side of the swing shaft. A through hole is formed in the pendulum engagement portion. The pendulum member is disposed to penetrate the through hole, and a peripheral surface of the pendulum member facing the through hole is formed into a tapered shape. The peripheral surface pushes up the inner periphery of the through hole to swing the hook member when the pendulum member vibrates. Thus, the earthquake-proof latch mechanism is made compact.

5 Claims, 9 Drawing Sheets

(51) Int. Cl.
*E05C 3/02* (2006.01)
*E05B 63/00* (2006.01)

(56) References Cited

FOREIGN PATENT DOCUMENTS

| | | |
|---|---|---|
| JP | A-2005-213955 | 8/2005 |
| JP | A-2007-154630 | 6/2007 |
| JP | A-2008-82167 | 4/2008 |
| JP | 2014-173276 A | 9/2014 |

OTHER PUBLICATIONS

International Search Report issued in International Patent Application No. PCT/JP2013/079207 mailed Jan. 21, 2014 (with translation).
Written Opinion of the International Searching Authority issued in issued in International Patent Application No. PCT/JP2013/079207 mailed Jan. 21, 2014 (with partial translation).

* cited by examiner

EARTHQUAKE-PROOF LATCH MECHANISM

TECHNICAL FIELD

The present invention relates to an earthquake-proof latch mechanism which engages with a reception portion provided in a door body when vibration occurs so that the earthquake-proof latch mechanism can lock and prevent the door body from opening.

BACKGROUND ART

An earthquake-proof latch has been heretofore used as a mechanism for preventing a door body of a sliding door, a hinged door or the like from being opened unintentionally to allow stored items to jump out when an earthquake occurs.

For example, in Patent Literature 1, there has been disclosed a structure in which a ball is vibratably received in a vibration area of a device body attached to the side of a shelf body so that a hook can be pushed up by motion of the ball so as to lock a door body to thereby prevent the door body from opening.

CITATION LIST

Patent Literature

Patent Literature 1: JP-A-2008-82167

SUMMARY OF INVENTION

Technical Problem

In the aforementioned structure described in Patent Literature 1, however, the ball must be disposed under the hook, so that it is difficult to make the device body compact. That is, when the ball is made smaller to downsize the device body in the structure described in Patent Literature 1, the inertia (force to swing the hook) of the ball is reduced in proportion to the weight of the ball and the height of the ball pushing up the hook cannot be secured. Due to the fear that the hook cannot be actuated surely, there is a limit in the downsizing. For this sake, there is a problem that the earthquake-proof latch cannot be installed if a space having a certain size cannot be secured.

Therefore, an object of the invention is to provide an earthquake-proof latch mechanism which is downsized as a device so that the earthquake-proof latch mechanism can be attached to a narrow space to which a background-art earthquake-proof latch mechanism cannot be attached.

Solution To Problem

In order to solve the foregoing problem, the present invention is characterized as follows.

An earthquake-proof latch mechanism according to a first aspect is an earthquake-proof latch mechanism which engages with a reception portion provided in a door body when vibration occurs so that the earthquake-proof latch mechanism can lock and prevent the door body from opening, the earthquake-proof latch mechanism includes: a case body; a hook member which is swingably supported on the case body; and a pendulum member which is vibratably suspended and supported on the case body; wherein: the hook member includes a hook on one side of a swinging shaft and a pendulum engagement portion on the other side of the swing shaft, the hook engaging with the reception portion, a through hole being formed in the pendulum engagement portion; the pendulum member is disposed to penetrate the through hole, and a peripheral surface of the pendulum member facing the through hole is formed into a tapered shape; and the peripheral surface pushes up an inner periphery of the through hole to swing the hook member when the pendulum member vibrates.

In addition to the aforementioned characteristic of the invention according to the first aspect, the invention according to a second aspect is characterized as follows.

That is, a bottom surface of the pendulum member does not touch any other member.

In addition to the aforementioned characteristic of the invention according to the first or second aspect, the invention according to a third aspect is characterized as follows.

That is, a bottom surface of the pendulum member is formed into a curved surface.

In addition to the aforementioned characteristic of the invention according to any one of the first through third aspects, the invention according to a fourth aspect is characterized as follows.

That is, the case body includes a pendulum reception chamber which receives the pendulum member; and the pendulum reception chamber is provided with a collision portion which allows the vibrating pendulum member to collide therewith to thereby change a vibrating direction of the pendulum member.

In addition to the aforementioned characteristic of the invention according to any one of the first through fourth aspects, the invention according to a fifth aspect is characterized as follows.

That is, the pendulum engagement portion has a front end extending obliquely downward in a non-vibration state.

According to the invention of the first aspect, as described above, when the pendulum member vibrates, the peripheral surface of the pendulum member pushes up the inner periphery of the through hole of the hook member to thereby swing the hook. With this structure, it is unnecessary to dispose the hook member and the pendulum member vertically so that it is possible to suppress the height of the device. It is therefore possible to provide a compact earthquake-proof latch mechanism.

In addition, according to the invention of the second aspect, as described above, the bottom surface of the pendulum member does not touch any other member so that the resistance of the pendulum member against vibration can be reduced. Thus, the pendulum member can be vibrated surely to actuate the earthquake-proof latch mechanism when an earthquake or the like occurs.

In addition, according to the invention of the third aspect, as described above, the bottom surface of the pendulum member is formed into a curved surface so that the center of gravity can be made as low as possible as long as the bottom surface of the pendulum reception chamber and the pendulum member do not interfere with each other. Accordingly, the height of the device can be suppressed, and the pendulum member can exert an enough force to push up the hook member.

In addition, according to the invention of the fourth aspect, as described above, the pendulum reception chamber is provided with the collision portion for allowing the vibrating pendulum member to collide therewith to thereby change the vibrating direction of the pendulum member. Accordingly, the vibrating pendulum member can be guided not to pass through the center as much as possible. That is, a state where the hook member is not pushed up by the pendulum member during vibration can hardly occur.

In addition, according to the invention of the fifth aspect, as described above, the pendulum engagement portion has the front end extending obliquely downward in the non-vibration state so that a large amplitude of vibration of the pendulum engagement portion can be secured. Accordingly, the height of the device can be suppressed, and a large swinging range of the hook member during vibration can be secured. Thus, the door body can be surely locked and prevented from opening.

DESCRIPTION OF EMBODIMENT

An embodiment of the invention will be described with reference to the drawings.

Figure 1:
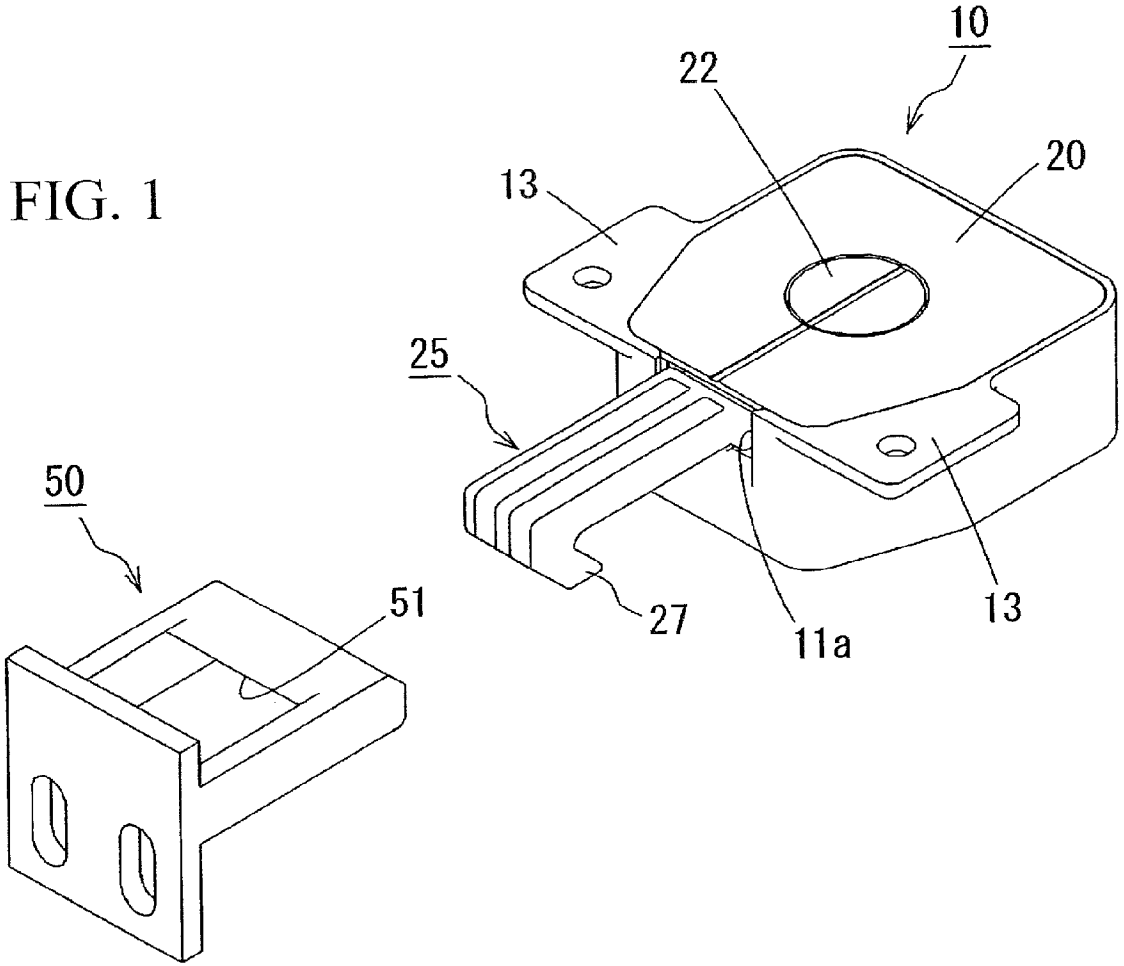
FIG. 1 An external perspective view of an earthquake-proof latch mechanism and a reception portion.
Figure 2A:
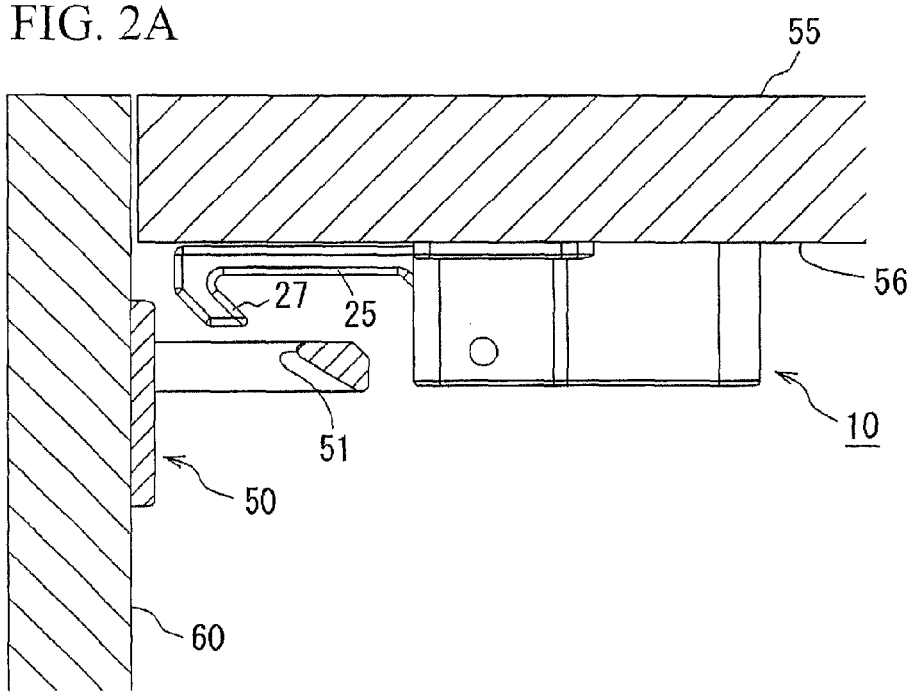
FIG. 2 Sectional views showing the relationship between the earthquake-proof latch mechanism and the reception portion, in which (a) is a view in a non-vibration state and (b) is a view in a vibration state.
Figure 2B:
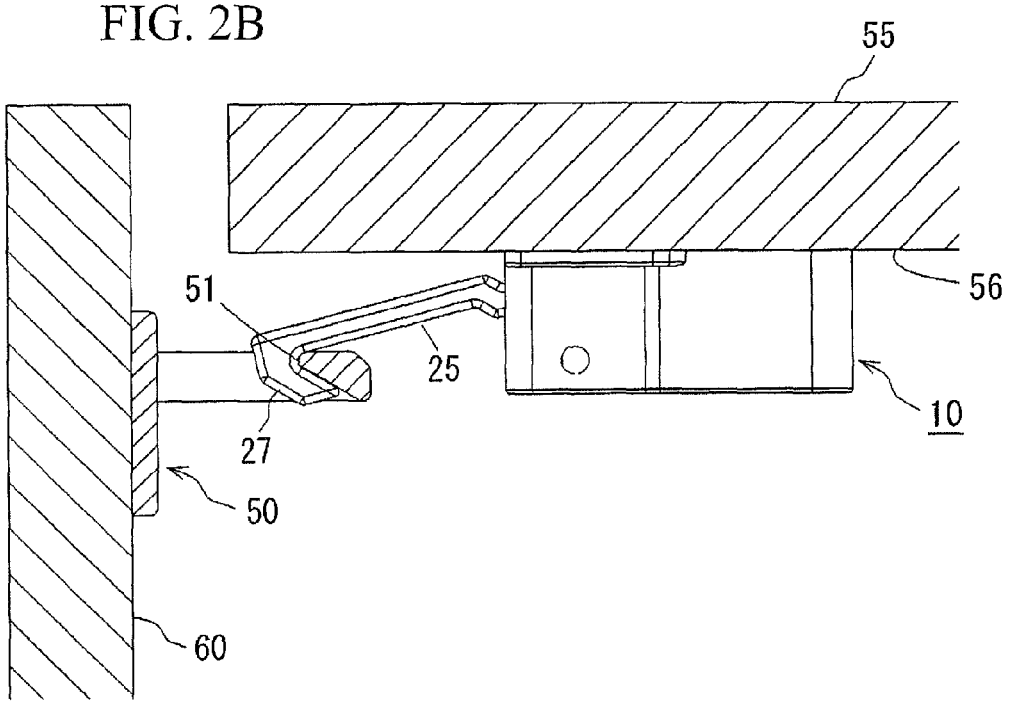
Figure 3A:
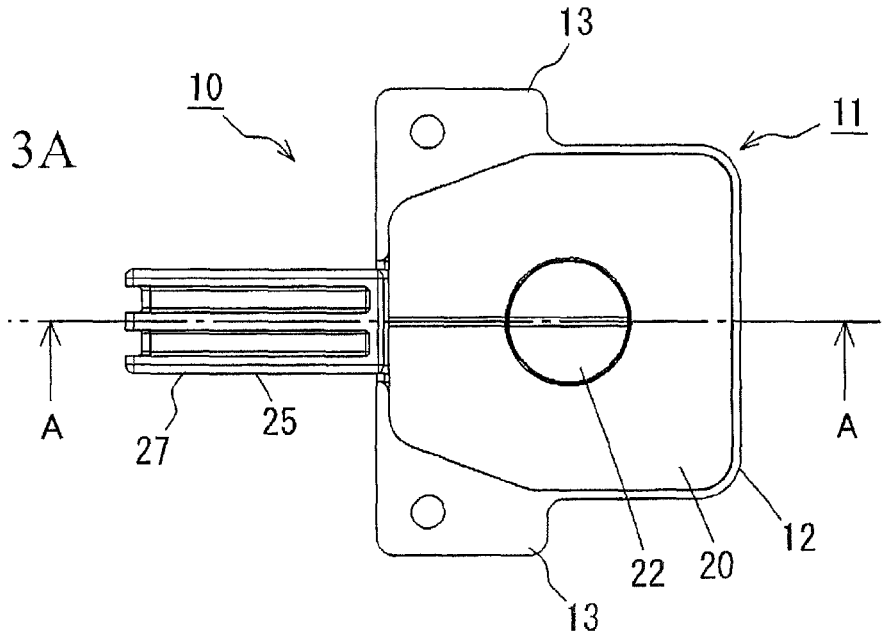
FIG. 3(*a*) is a plan view of the earthquake-proof latch mechanism and (*b*) is a side view of the same.
Figure 3B:
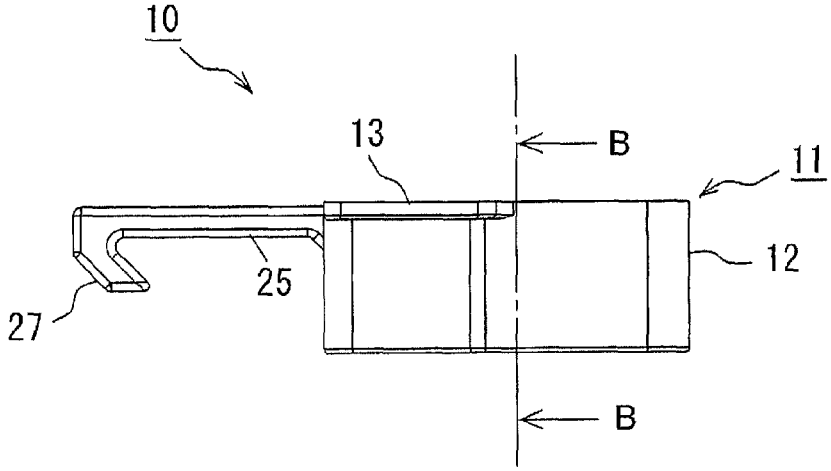

An earthquake-proof latch mechanism 10 according to this embodiment is provided for engaging with a reception portion 50 to thereby lock and prevent a door body 60 from opening, as shown in FIG. 1. For example, as shown in FIG. 2, the reception portion 50 is fixed to the back side of the door body 60, and the earthquake-proof latch mechanism 10 is fixed to the top side of a top plate 56 of a housing 55. Thus, the reception portion 50 and the earthquake-proof latch mechanism 10 are disposed to face each other. A hook 27 protrudes from an opening portion 11*a* of a case body 11 of the earthquake-proof latch mechanism 10, and is disposed to engage with a hook engagement portion 51 of the reception portion 50 when the hook 27 swings in the state where the door body 60 has been closed. When vibration such as an earthquake occurs in this state, an internal mechanism of the earthquake-proof latch mechanism 10 which will be described later is actuated to swing the hook 27 protruding from the opening portion 11*a*. As shown in FIG. 2(*b*), the swinging hook 27 engages with the hook engagement portion 51 of the reception portion 50 so as to lock and prevent the door body 60 from opening. When the vibration goes on, the state where the hook 27 has fallen down is maintained so that the lock cannot be cancelled but the door body 60 can be prevented from opening unintentionally to allow stored items to jump out. When the vibration stops, the hook 27 is put into a state where the hook 27 is lifted up as shown in FIG. 2(*a*), so that the door body 60 can be released from the lock.

Figure 4:
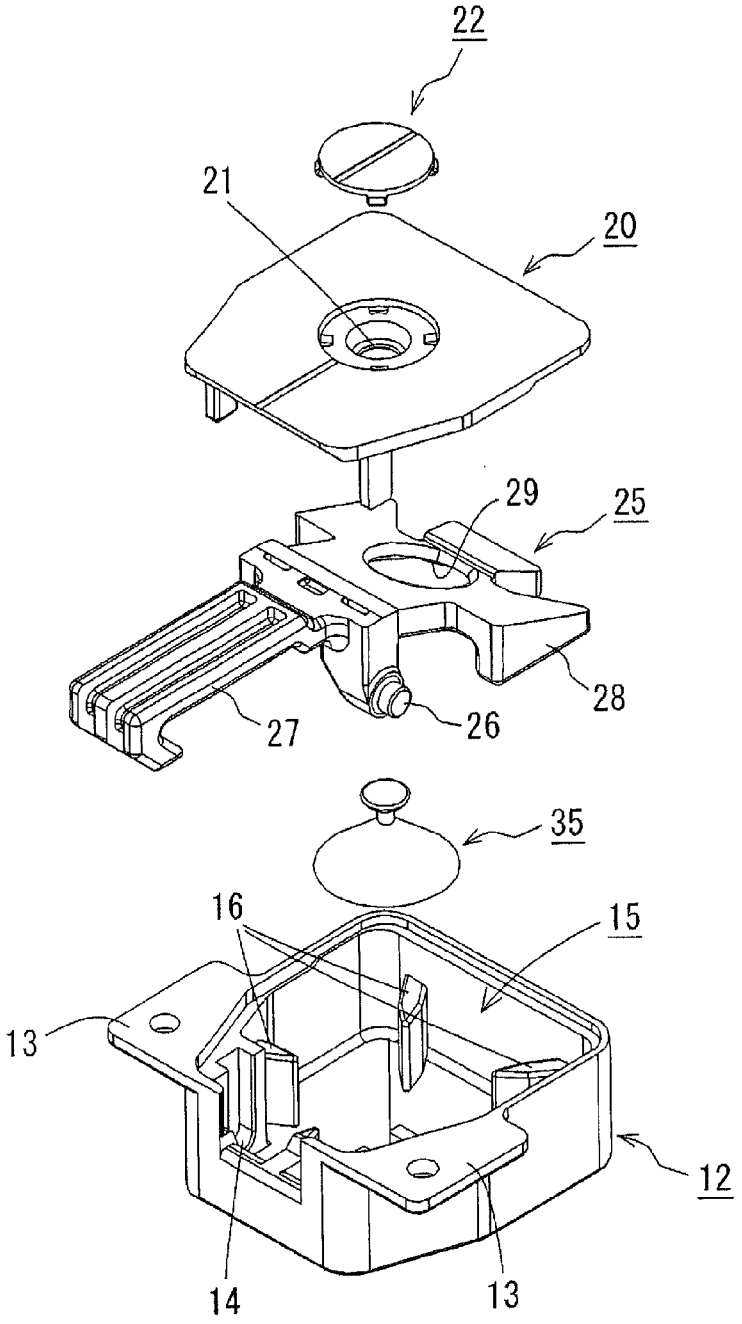
FIG. 4 An exploded perspective view of the earthquake-proof latch mechanism.

This earthquake-proof latch mechanism 10 is provided with a case body 11 which includes an actuation mechanism, a hook member 25 which is swingably supported on the case body 11, and a pendulum member 35 which is vibratably suspended and supported on the case body 11, as shown in FIG. 4.

The case body 11 has a case main body 12 whose top side is open, a case cover portion 20 which covers the top side of the case main body 12, and a cap 22 which is attached to the top side of the case cover portion 20.

Figure 7A:
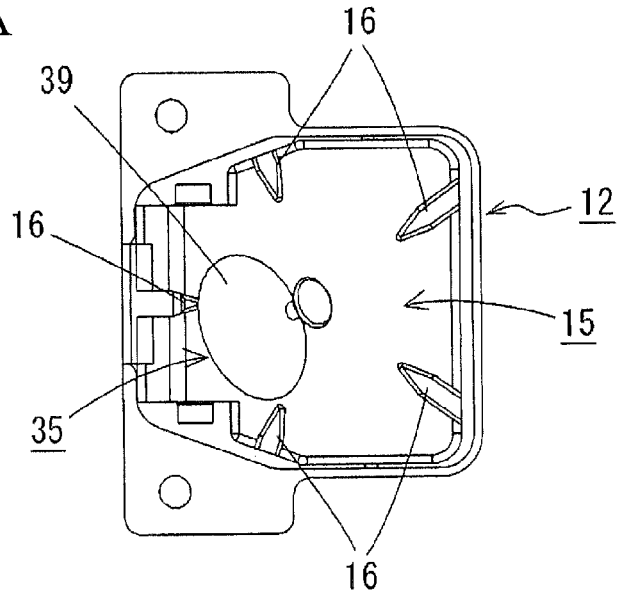
FIG. 7 Views showing the interior of a case body when the pendulum member vibrates.
Figure 7B:
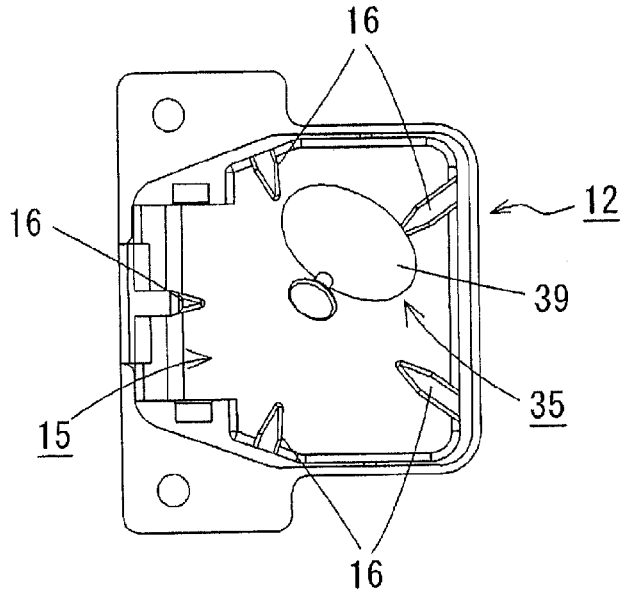

The case main body 12 is a member provided with a pendulum reception chamber 15 for receiving a rear end portion of the hook member 25 and the pendulum member 35. Rib-like collision portions 16 are provided inside the pendulum reception chamber 15 so as to protrude toward the center as shown in FIG. 7. In this embodiment, the collision portions 16 are disposed in five places at predetermined intervals.

The case main body 12 is provided with attachment pieces 13 protruding in left and right. Screws are attached to penetrate the attachment pieces 13 so that the case main body 12 can be fixed to a desired attachment position (for example, the top plate portion 56 of the housing 55 shown in FIG. 2). In addition, the case main body 12 is provided with a bearing portion 14 for swingably supporting the hook member 25 as shown in FIG. 4.

The case cover portion 20 is a member for closing the top portion of the pendulum reception chamber 15 of the case main body 12. The pendulum reception chamber 15 is closed by the case cover portion 20 so that the hook member 25 and the pendulum member 35 received in the case main body 12 can be prevented from jumping out to the outside. An engagement hole 21 for vibratably suspending and supporting the pendulum member 35 is formed near the planar-view center of the case cover portion 20 so as to penetrate the case cover portion 20.

The cap 22 is a member which is fitted and fixed to the top side of the case cover portion 20. When the cap 22 is attached, a portion of the aforementioned case cover portion 20 upper than the engagement hole 21 is closed. Thus, the front end of the pendulum member 35 engaged with the engagement hole 21 can be prevented from jumping out upward.

Figure 6A:
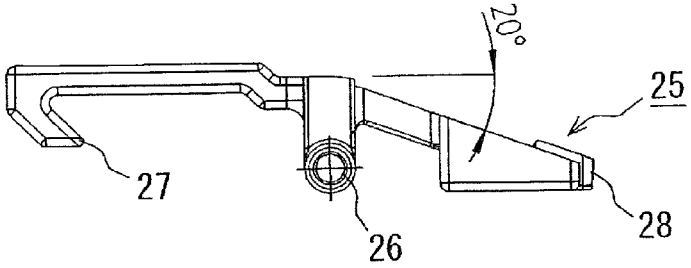
FIG. 6 Side views of a hook member, in which (a) is a view in a non-vibration state and (b) is a view in a vibration state.
Figure 6B:
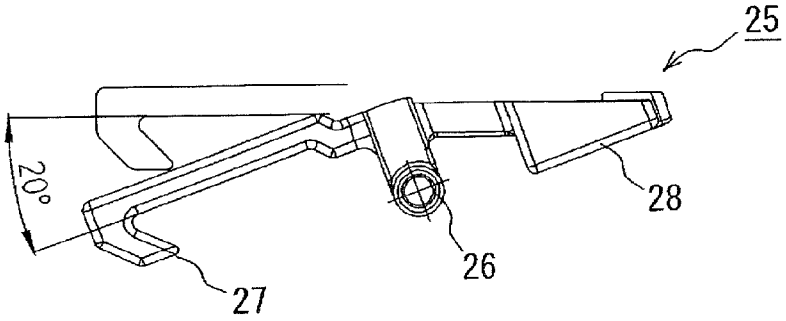

The hook member 25 has a swinging shaft 26, a hook 27 which is formed on one side of the swinging shaft 26, and a pendulum engagement portion 28 which is formed on the other side of the swinging shaft 26, as shown in FIG. 4 and so on. The swinging shaft 26 is formed to protrude on the opposite sides of the hook member 25, and swingably supported on the bearing portion 14 of the case body 11. The hook 27 has a hook-shaped front end. This hook-shaped front end engages with the reception portion 50 so that the door body 60 can be locked and prevented from opening. The pendulum engagement portion 28 is a portion in which a through hole 29 to be penetrated by the pendulum member 35 is formed near the center. The pendulum engagement portion 28 is a portion which engages with the pendulum member 35 so as to be pushed up when the pendulum member 35 vibrates. The hook 27 and the pendulum engagement portion 28 are not formed to extend in parallel with each other but are formed to extend to each other with the interposition of the swing shaft 26 so as to form an angle of about 20 degrees therebetween, as shown in FIG. 6.

Figure 5A:
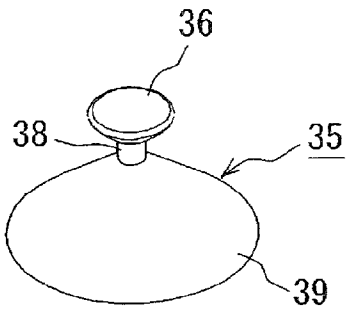
FIG. 5(*a*) is a perspective view of a pendulum member and (*b*) is a side view of the same.
Figure 5B:
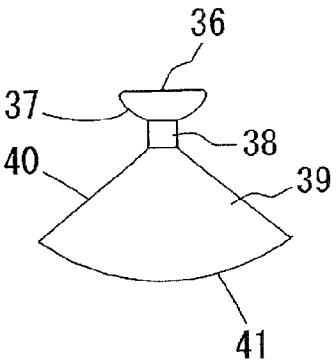

The pendulum member 35 is a member in which an upper engagement portion 36 and a lower swinging cone portion 39 are coupled to each other vertically by an intermediate shaft 38 as shown in FIG. 5. The engagement portion 36 is a semispherical portion in which an under-neck peripheral surface 37 is formed into a curved surface. When the engagement portion 36 engages with the aforementioned engagement hole 21 of the case cover portion 20, the pendulum member 35 is vibratably suspended and supported. On the other hand, the swinging cone portion 39 is a substantially conical portion in which a bottom surface 41 is formed into a curved surface. The pendulum member 35 is disposed to penetrate the through hole 29 of the hook member 25 so that a tapered peripheral surface 40 of the swinging cone portion 39 can be disposed to face the inner periphery of the through hole 29, as shown in FIGS. 8 and 9.

Figure 8A:
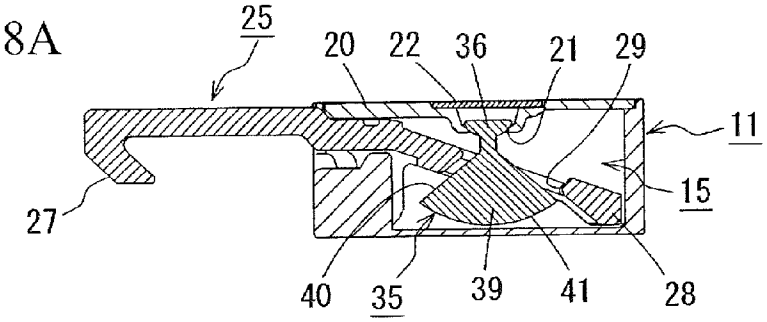
FIG. 8(*a*) is a sectional view taken on line A-A in a non-vibration state and (*b*) is a sectional view taken on line B-B in the same state.
Figure 8B:
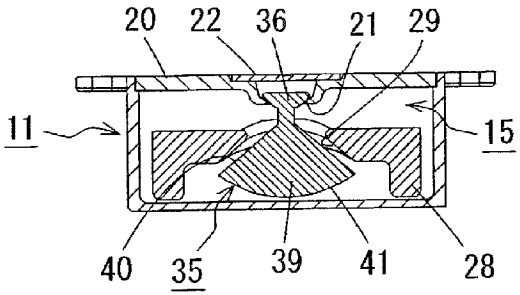

In a non-vibration state, the earthquake-proof latch mechanism 10 keeps the posture in which the hook 27 is lifted up substantially horizontally as shown in FIG. 8(*a*). That is, since the hook member 25 is formed so that the pendulum engagement portion 28 side is heavier than the hook 27 side, the pendulum engagement portion 28 side moves down due to its own weight while the upper portion of the hook 27 lifted up abuts against the case cover portion 20. Thus, the hook 27 becomes substantially horizontal. On this occasion, the pendulum engagement portion 28 is provided to extend obliquely at an inclination angle of about 20 degrees with respect to the extending direction of the hook 27. Thus, the front end of the pendulum engagement portion 28 extends obliquely downward toward the rear and lower side of the pendulum reception chamber 15.

Figure 9A:
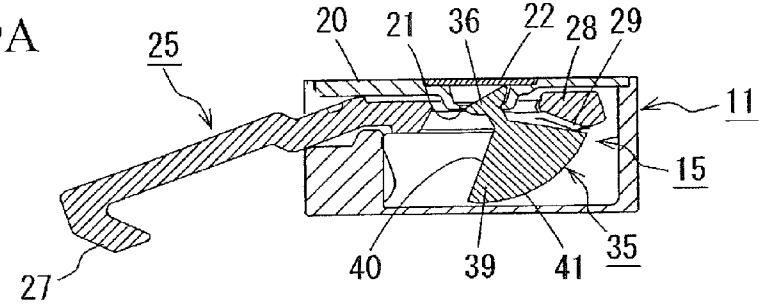
FIG. 9(*a*) is a sectional view taken on line A-A in a vibration state and (*b*) is a sectional view taken on line B-B in the same state.
Figure 9B:
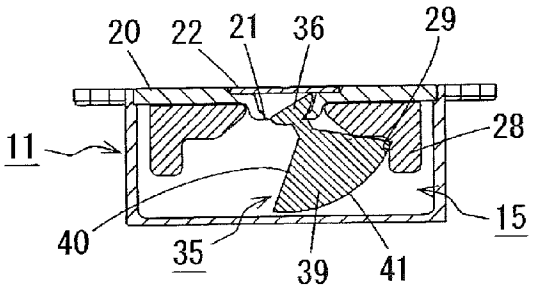

When vibration such as an earthquake occurs, the pendulum member 35 vibrates and the peripheral surface 40 of the pendulum member 35 pushes up the inner periphery of the through hole 29 of the hook member 25 so as to swing the hook member 25, as shown in FIGS. 9A and 9B. Thus, the hook 27 tilts with its front end moving down so that the hook 27 engages with the reception portion 50.

On that occasion, the pendulum member 35 can swing to the position where the pendulum member 35 abuts against the case cover portion 20. When the pendulum member 35 swings thus to the position where the pendulum member 35 abuts against the case cover portion 20, the pendulum engagement portion 28 becomes substantially horizontal. That is, the angle between the hook 27 and the pendulum engagement portion 28 (about 20 degrees in this embodiment) corresponds to the angle with which the hook member 25 can swing. With this configuration, the interior of the pendulum reception chamber 15 can be used as widely as possible so that the pendulum engagement portion 28 can be swung therein. Accordingly, a large amplitude of vibration of the hook member 25 can be secured while the height of the pendulum reception chamber 15 (that is, the height of the case body 11) is reduced.

The pendulum member 35 vibrating inside the pendulum reception chamber 15 collides with the aforementioned collision portions 16 as shown in FIG. 7. The collision portions 16 are provided at intervals which are enough small to prevent the pendulum member 35 from abutting against the inner wall of the pendulum reception chamber 15. Thus, the pendulum member 35 vibrating largely always collides with the collision portions 16. Since the pendulum member 35 collides with the collision portions 16 in this manner, the vibrating direction of the pendulum member 35 changes irregularly. Since the vibrating direction of the pendulum member 35 changes irregularly, the pendulum member 35 can be guided not to pass through the center (the position to which the pendulum member 35 comes in a non-vibration state) as much as possible. That is, the state where the pendulum member 35 does not push up the hook member 25 may occur instantaneously when the pendulum member 35 passes through the center during vibration. Therefore, in order to prevent occurrence of such a state as much as possible, the pendulum member 35 is vibrated irregularly. Even when the pendulum member 35 passes through the center during vibration, the hook member 25 does not return to its original position immediately. Therefore, there is no fear that the hook 27 is released from engagement. With the provision of the aforementioned collision portions 16, the hook 27 can be further surely prevented from being unintentionally released from the engagement.

The bottom surface 41 of the aforementioned pendulum member 35 floats in the air not to touch any other member, as shown in FIG. 8. The bottom surface 41 is formed into a spherical surface which is concentric with the under-neck peripheral surface 37 of the engagement portion 36. Therefore, even when the pendulum member 35 vibrates, the bottom surface 41 of the pendulum member 35 vibrates without touching the bottom surface of the pendulum reception chamber 15 while keeping a substantially fixed distance therefrom. Thus, the center of gravity of the pendulum member 35 can be made lower and heavier while the pendulum member 35 and the pendulum reception chamber 15 do not touch each other. Thus, a useless frictional force is not generated. That is, the vibrating force of the pendulum member 35 can be increased while the motion of the pendulum member 35 can be prevented from being disturbed. As a result, the pendulum member 35 can push up and swing the hook member 25 surely.

According to the embodiment, as described above, the peripheral surface 40 of the pendulum member 35 pushes up the inner periphery of the through hole 29 of the hook member 25 to thereby swing the hook member 25 when the pendulum member 35 vibrates. With this structure, it is not necessary to dispose the hook member 25 and the pendulum member 35 vertically, so that it is possible to suppress the height of the device. It is therefore possible to provide a compact earthquake-proof latch mechanism 10.

In addition, the bottom surface 41 of the pendulum member 35 does not touch any other member. Accordingly, the resistance of the pendulum member 35 against vibration can be reduced so that the pendulum member 35 can be surely vibrated to actuate the earthquake-proof latch mechanism 10 when an earthquake or the like occurs.

In addition, since the bottom surface 41 of the pendulum member 35 is formed into a curved surface, the center of gravity can be made as low as possible as long as the bottom surface of the pendulum reception chamber 15 and the pendulum member 35 do not interfere with each other. Therefore, the height of the device can be suppressed, and the pendulum member 35 can exert an enough force to push up the hook member 25.

In addition, the pendulum reception chamber 15 is provided with the collision portions 16 which allow the vibrating pendulum member 35 to collide therewith to thereby change the vibrating direction of the pendulum member 35. Accordingly, the vibrating pendulum member 35 can be guided not to pass through the center as much as possible. That is, a state where the hook member 25 is not pushed up by the pendulum member 35 during vibration can hardly occur.

In addition, the pendulum engagement portion 28 has the front end extending obliquely downward in a non-vibration state. Accordingly, a large amplitude of vibration of the pendulum engagement portion 28 can be secured. Thus, the height of the device can be suppressed and the swinging range of the hook member 25 can be secured largely during vibration. It is therefore possible to lock and prevent the door body 60 from opening surely.

REFERENCE SIGNS LIST

10 earthquake-proof latch mechanism
11 case body
11*a* opening portion
12 case main body
13 attachment piece
14 bearing portion
15 pendulum reception chamber
16 collision portion
20 case cover portion
21 engagement hole
22 cap
25 hook member
26 swinging shaft
27 hook
28 pendulum engagement portion
29 through hole
35 pendulum member
36 engagement portion
37 under-neck peripheral surface
38 intermediate shaft
39 swinging cone portion
40 peripheral surface
41 bottom surface
50 reception portion
51 hook engagement portion
55 housing
56 top plate portion
60 door body

The invention claimed is:

1. An earthquake-proof latch mechanism which engages with a reception portion provided on a door body when vibration occurs so that the earthquake-proof latch mechanism can lock and prevent the door body from opening, the earthquake-proof latch mechanism comprising:

a case body;

a hook member which is swingably supported in the case body; and a pendulum member which is vibratably suspended and supported in the case body; wherein:

the hook member includes a hook on one side of a swinging shaft and a pendulum engagement portion on another side of the swinging shaft, the hook engaging with the reception portion, a through hole being formed in the pendulum engagement portion;

the pendulum member is disposed to penetrate the through hole, and a peripheral surface of the pendulum member facing the through hole is formed into a tapered shape; and the peripheral surface pushes up an inner periphery of the through hole to swing the hook member when the pendulum member vibrates.

2. An earthquake-proof latch mechanism according to claim 1, wherein:

a bottom surface of the pendulum member does not touch any other member.

3. An earthquake-proof latch mechanism according to claim 1, wherein:

a bottom surface of the pendulum member is formed into a curved surface.

4. An earthquake-proof latch mechanism according to claim 1, wherein:

the case body includes a pendulum reception chamber which receives the pendulum member; and the pendulum reception chamber is provided with a collision portion which allows the vibrating pendulum member to collide therewith to thereby change a vibrating direction of the pendulum member.

5. An earthquake-proof latch mechanism according to claim 1, wherein:

the pendulum engagement portion has a front end extending obliquely downward in a non-vibration state.

* * * * *